US005271477A

United States Patent [19]

Gekka et al.

[11] Patent Number: 5,271,477

[45] Date of Patent: Dec. 21, 1993

[54] OXYGEN SENSOR LAYOUT

[75] Inventors: Ryoichi Gekka; Masaki Takegami; Tomokazu Ito; Akira Yokoo, all of Iwata, Japan

[73] Assignee: Yamaha Hatsudoki Kabushiki Kaisha, Iwata, Japan

[21] Appl. No.: 834,472

[22] Filed: Feb. 12, 1992

[30] Foreign Application Priority Data

Feb. 22, 1991 [JP] Japan ..... 3-50412

[51] Int. Cl.[5] ..... B62D 61/02

[52] U.S. Cl. ..... 180/219; 180/309; 60/302; 60/323

[58] Field of Search ..... 180/219, 225, 296, 309, 180/89.2; 60/302, 323, 276

[56] References Cited

U.S. PATENT DOCUMENTS 4,007,589 2/1977 Neidhard et al. ..... 60/276
4,484,650 11/1984 Isaka et al. ..... 180/219
4,553,388 11/1985 Okubo et al. .

FOREIGN PATENT DOCUMENTS 101826 6/1983 Japan ..... 180/219
152115 9/1983 Japan ..... 60/302
32920 2/1985 Japan ..... 60/323
135896 6/1991 Japan ..... 180/219

OTHER PUBLICATIONS

Patent Abstracts of Japan vol. 008, No. 210(M-328)Sep. 26, 1984 and JP-A-59 099 021(Honda)Jun. 7, 1984.
P.A. of Japan vol. 009, No. 142(M388)Jun. 18, 1985 and JP-A-60 022 017(Yamaha) Feb. 4, 1985.
P.A. of Japan vol. 006, No. 056(M-121) Apr. 13, 1982 and JP-A-56 167 811 (Yamaha)Dec. 23, 1981.

*Primary Examiner*—David M. Mitchell
*Assistant Examiner*—Gary C. Hoge
*Attorney, Agent, or Firm*—Ernest A. Beutler

[57] ABSTRACT

A motorcycle having an exhaust system with a sensor in the exhaust system for engine control. The sensor is located so that it will be protected by the exhaust device into which it protrudes and by other portions of the motorcycle. The exhaust system includes a plurality of exhaust pipes and the exhaust device and one of these exhaust pipes is readily removable from a unitary assembly comprised of the remaining exhaust pipes and exhaust device so that an adjacent component of the motorcycle can be easily serviced.

20 Claims, 3 Drawing Sheets

OXYGEN SENSOR LAYOUT

BACKGROUND OF THE INVENTION

This invention relates to a motorcycle and more particularly to an improved sensor layout for the exhaust system of a motorcycle.

As is well known, considerable attempts are being made to reduce the pollution of undesirable exhaust gas constituents from the exhaust gases of internal combustion engines and to improve their fuel economy. These efforts are not limited to automotive applications but also apply to motorcycles. However, the problems attended with emission control on motorcycles is aggravated by the extremely compact nature of such vehicles and also the fact that the running components of motorcycles are generally exposed to the atmosphere and may be subject to damage.

Specifically, it has been proposed to employ not only catalytic treatment for the exhaust gases of motorcycle engines but also to employ various sensors that protrude into the exhaust system for sensing the combustion conditions of the engine. For example, the use of oxygen sensors in the exhaust system is particularly desirable for combustion control. However, the sensor in addition to protruding into the exhaust system also has an exposed portion that provides the output connection for the engine control system. Usually the exhaust system in a motorcycle is disposed quite low and frequently the converter or muffler may be positioned beneath the crankcase of the engine. Hence, the sensor is exposed to damage from articles that may be thrown up by the rotation of the wheels and other foreign objects.

It addition to these problems, motorcycles are leaned when negotiating curves. This leaning operation causes the exhaust device in which the sensor is positioned to move quite close to the ground. If the sensor is positioned at a low location in the exhaust device in which it is inserted, it actually may strike the ground during these leaning operations.

It is, therefore, a principal object to this invention to provide an improved sensor arrangement for the exhaust system of a motorcycle.

It is a further object to this invention to provide a sensor arrangement for a motorcycle exhaust system wherein the sensor will be protected from foreign objects or damage upon leaning of the motorcycle.

It is a further object to this invention to provide an arrangement for positioning a sensor in the exhaust system of a motorcycle so that it will be protected by the exhaust device into which it is positioned.

As has been noted, motorcycles are extremely compact devices and the placement of the various components can present several problems. In this regard, it is a normal practice to provide an exhaust system that includes exhaust pipes that extend from the exhaust ports of the engine downwardly to deliver exhaust gases to an exhaust device which is positioned at the lower portion of the motorcycle and frequently beneath the engine of the motorcycle. For ease of assembly, it has been the practice to form the exhaust pipes and the exhaust device as a unitary assembly. However, such exhaust pipe and exhaust device placement can frequently position the exhaust pipes in an area where they obscure a component of the motorcycle which may require servicing. In order to reach this component, therefore, it is necessary to remove the complete exhaust system.

It is, therefore, a still further object to this invention to provide an improved exhaust system for a motorcycle wherein at least a portion of the exhaust system may be readily detached from the other exhaust system components which form a unitary assembly to offer ease of servicing.

SUMMARY OF THE INVENTION

This invention is adapted to be embodied in a motorcycle having a body assembly supported upon a dirigible front wheel and a rear wheel at least one of which is driven by an internal combustion engine mounted in the body assembly. An exhaust system is incorporated for discharging exhaust gases from the engine to the atmosphere and includes an exhaust device for treating the exhaust gases and which is positioned at a lower portion of the body assembly and between the front and rear wheels. The exhaust device has peripheral side edges in front elevation that lie within a pair of intersecting planes meeting at a line defined by the center of contact of the front and rear wheels with a ground plane upon which the motorcycle is disposed. A sensor is mounted at least in part within the exhaust device and has a portion thereof extending outside the exhaust device and beyond the outer periphery of the exhaust device. The sensor portion lies outside of the surface area of the exhaust device extending between the planes for protecting the sensor from foreign objects by the exhaust device.

Another feature of this invention is adapted to be embodied in a motorcycle having a body assembly supported upon a dirigible front wheel and a rear wheel at least one of which is driven by an internal combustion engine mounted in the body assembly. An exhaust system is incorporated for exhausting gases from the engine to the atmosphere and includes a plurality of exhaust pipes that extend from exhaust ports of the engine downwardly and beneath the engine. The exhaust pipes deliver the exhaust gases to an exhaust device positioned beneath the engine. At least one of the exhaust pipes is disposed adjacent to a component of the motorcycle that is to be serviced. This exhaust pipe is a separately removable component from the exhaust system and the remaining exhaust pipes and exhaust device form a unitary assembly.

DETAILED DESCRIPTION OF THE PREFERRED EMBODIMENTS OF THE INVENTION

Figure 1:
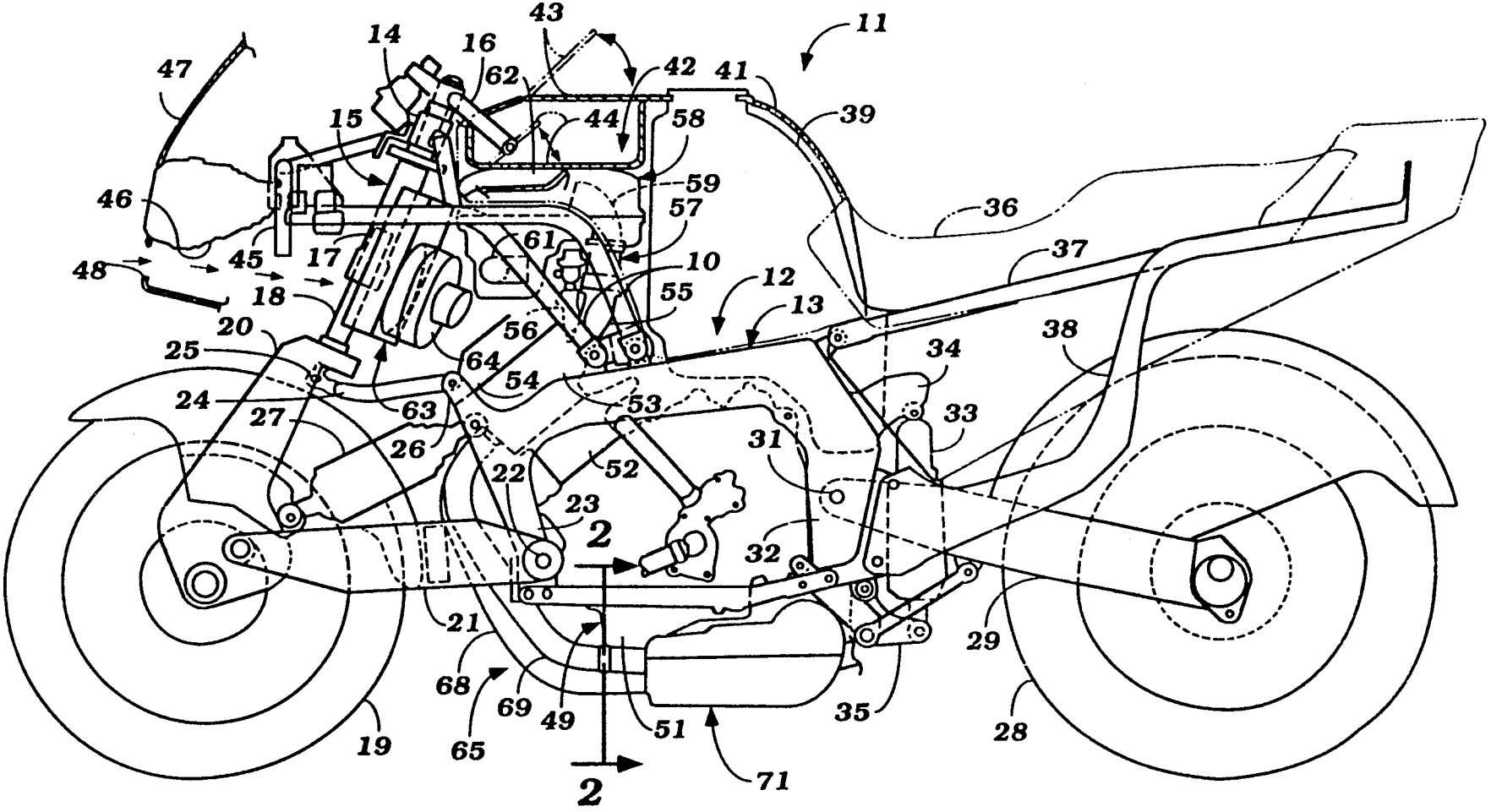
FIG. 1 is a side elevational view of a motorcycle constructed in accordance with an embodiment of the invention, with portions broken away and shown in section.
Figure 2:
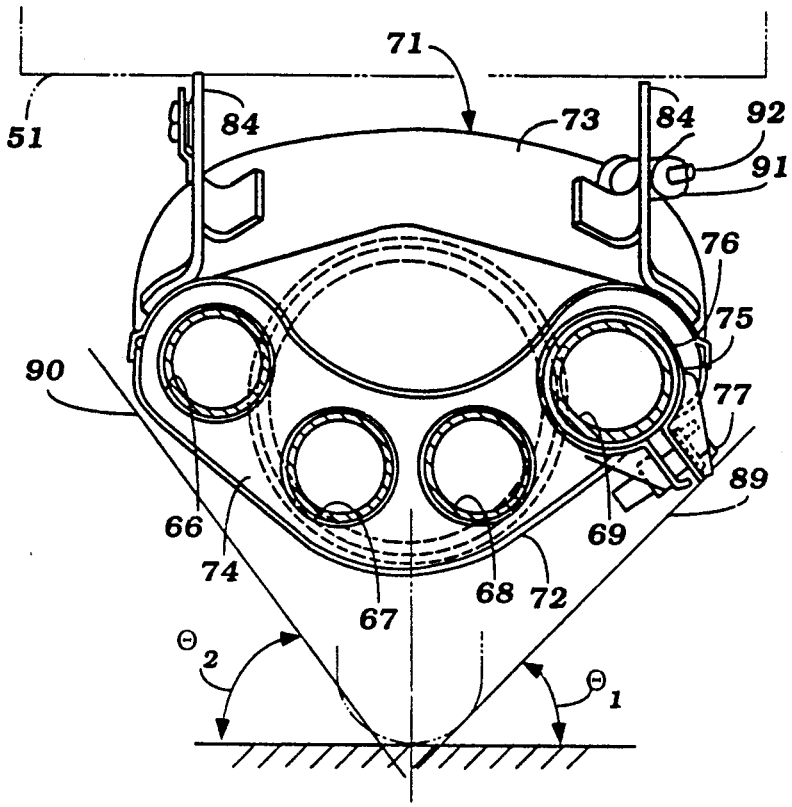
FIG. 2 is an enlarged cross sectional view taken along the line 2—2 of FIG. 1.
Figure 3:
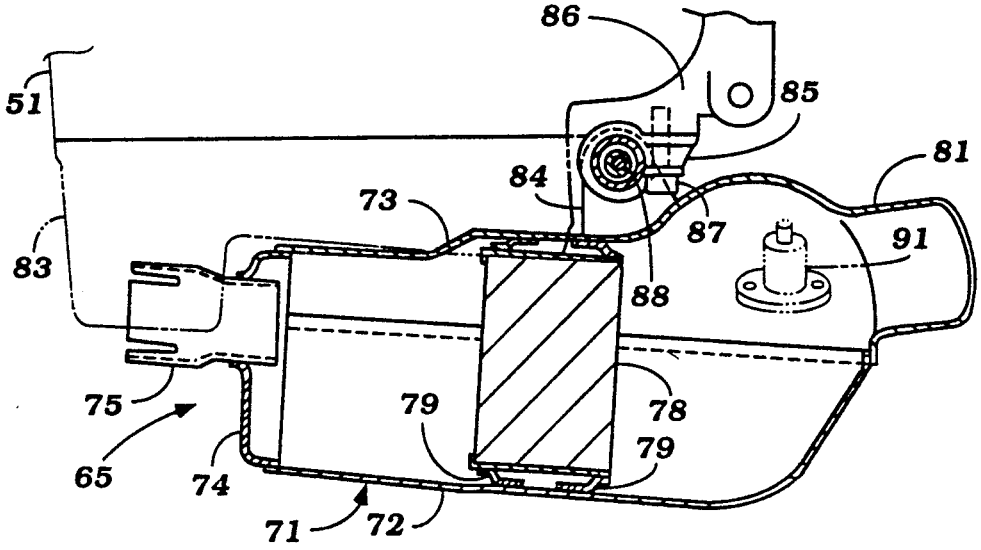
FIG. 3 is a cross sectional view taken along a plane extending perpendicular to the plane of FIG. 2.

Referring now in detail to the drawings and initially to FIG. 1, a motorcycle constructed in accordance with an embodiment of the invention is identified generally by the reference numeral 11. The motorcycle 11 is comprised of a frame assembly, indicated generally by the reference numeral 12 and which includes a pair of inverted U-shaped side members 13 which are connected to each other in a suitable manner. A head pipe 14 is supported from the side members 13 by means of a pair of head pipe supporting brackets 10.

The head pipe 14 supports a steering shaft 15 for rotation about a generally vertically disposed steering axis that is slightly inclined from the vertical in a rearward direction. A handle bar assembly 16 at the upper end of the steering shaft 15 rotatably positions the steering shaft in a known manner. The steering shaft 15 includes an upper shaft portion 17 and a lower shaft portion 18 that have a splined or tubular connection that permits vertical movement of a front wheel 19 that is carried by a steering bracket or hub carrier 20 which is affixed suitably to the lower steering shaft portion 18.

The hub carrier 20 is supported relative to the frame assembly 12 by a suspension including a generally H-shaped leading arm, indicated by the reference numeral 21. The leading arm 21 is shown in phantom in FIG. 4 and it may be seen that the parallel H-shaped arms extend rearwardly. These arms have a pair of spaced apart pivot connections 22 to depending portions 23 of the frame side members 13. In addition, an upper link 24 has a universal connection 25 to the hub carrier 20 and a rearward pivotal connection to an upstanding portion 26 of the frame members 13. A suspension element 27 is loaded between the frame members 13 and the hub carrier 20 for controlling the suspension movement of the front wheel 19 relative to the frame assembly 12.

A rear wheel 28 is rotatably journaled at the rear end of a trailing arm 29. The trailing arm 29 has a pivotal connection 31 to a rear leg 32 of the frame members 13. A suspension element 33 controls the movement of the trailing arm 29 and rear wheel 28 relative to the frame assembly 13. The suspension element 33 is loaded between a frame bracket 34 and a linkage system 35 that is interconnected to the trailing arm 29 and the frame assembly in any known manner.

A seat 36 is mounted at the rear of the frame assembly 13 on a pair of seat rails 37 which are connected at their forward ends to the frame members 13 and which are supported at their rearward ends by stays 38.

A fuel tank 39 is positioned forwardly of the seat 36 and is covered in part by a body assembly including a tank cover 41.

Forwardly of the fuel tank 39 is a glove box 42 which is assessable through a pivotally supported cover 43. The floor of the glove box 42 has a further access opening that is closed by a pivotally supported closure 44 for accessing control components of the powering internal combustion engine of the motorcycle 11, to be described. The glove box 42 is disposed rearwardly of the handle bars 16.

The head pipe brackets 10 have at their forward ends a cross bracket 45 that mounts a head light 46 which protrudes through a portion 47 of the body. An air inlet opening 48 is formed beneath the head light 46 for admitting cooling air, for a purpose to be described.

An internal combustion engine, indicated generally by the reference numeral 49 is suitably mounted in the frame assembly 12 for driving the rear wheel 28. The internal combustion engine 49, as is typical with motorcycle practice, has a crankcase transmission assembly 51 in which the crankshaft (not shown) of the engine 49 is rotatably journalled and which contains a change speed transmission that drives the rear wheel 28 either through a conventional type of shaft drive or a conventional type of chain drive.

The engine 49 is of the four cylinder in-line type and includes a cylinder block 52 having aligned cylinder bores that are inclined from the vertical in a forwardly extending direction. A cylinder head assembly 53 is affixed to the cylinder block 52 and contains an overhead valve arrangement that is operated by a pair of overhead cams enclosed by a cam cover 54. Since the internal components of the engine 49 form no part of the invention nor is a description of them necessary to understand the invention, the engine 49 will not be described in any more detail, except for a brief description of its induction system.

This induction system includes an intake manifold 55 into which fuel injectors 56 direct a fuel spray as disclosed in the co-pending application entitled "Air Intake System For A Fuel Injection Type Four Cylinder Engine", Ser. No. 834,474, filed Feb. 12, 1992, and assigned to the Assignee hereof. That co-pending application describes in some detail the construction of the cylinder head and porting arrangement and is incorporated herein by reference.

A throttle body assembly 57 is affixed to the upper portion of the intake manifold 55 and draws air through an air inlet device including a filtering arrangement, indicated generally by the reference numeral 58. Air trumpets 59 extend from the throttle body 57 into the interior of the air inlet device 58.

The air inlet device 58 draws atmospheric air through a pair of rearwardly facing air inlet pipes 61. The air inlet device 58 also has a depressed upper wall forming a recess 62 disposed below the glove box 42 and accessible through the closure 44. A control device such as a CPU for controlling the injection and ignition system of the engine may be positioned in the recess 62.

The engine 49 is also at least in part water cooled and the cooling system for the engine includes a cross flow type of radiator 63 that is positioned behind the front cowling 47 and receives air flowing through the inlet opening 48. A pair of electrically operated fans 64 assist in the air flow across the radiator 63. The construction of the radiator 63 and its cooperation with the engine cooling system is as described in the co-pending application entitled "Radiator Disposing Structure For A Motorcycle", Ser. No. 834,475, filed Feb. 12, 1992, and now issued as U.S. Pat. No. 5,176,111 on Jan. 5, 1993 and assigned to the Assignee hereof the disclosure of which is incorporated herein by reference.

The engine 49 and specifically the cylinder head assembly 53 has four forwardly and downwardly facing exhaust ports, one for each cylinder. An exhaust system, indicated generally by the reference numeral 65 receives exhaust gases from these exhaust ports and discharges them to the atmosphere in a manner which will now be described by particular reference to the remaining figures. The exhaust system 65 includes four exhaust pipes 66, 67, 68 and 69 each of which is flanged at its inlet end for attachment to the exhaust ports of the cylinder head 53 in a well known manner. The exhaust pipes 66, 67, 68 and 69 deliver the exhaust gases to an exhaust device, indicated generally by the reference numeral 71 which exhaust device, in the illustrated embodiment is a combined muffler and catalytic converter.

Figure 4:
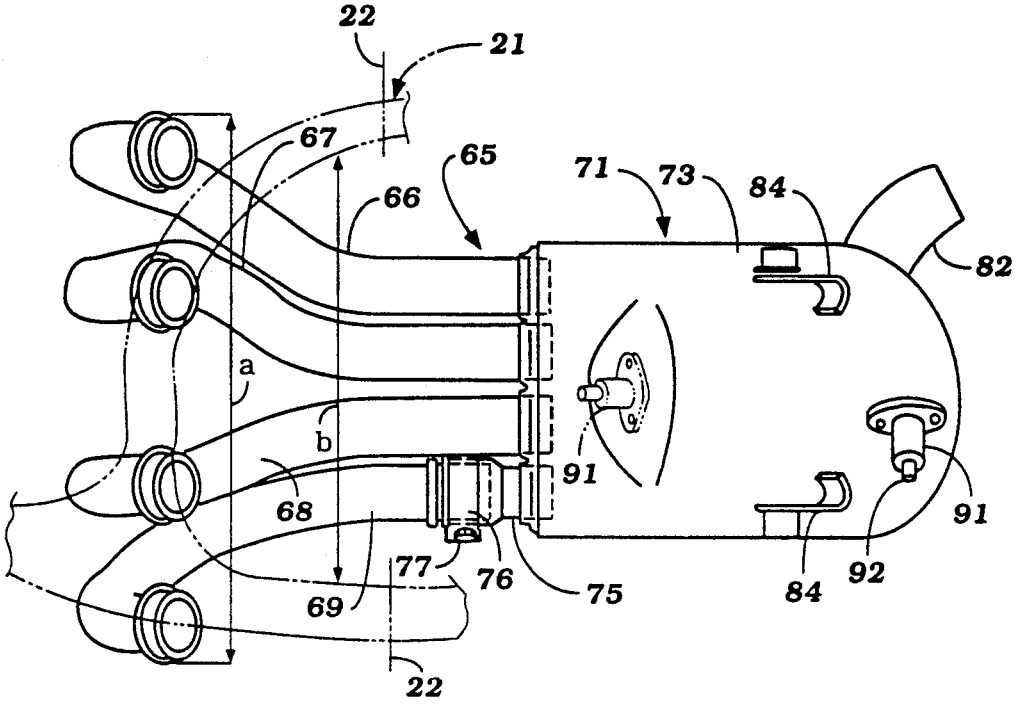
FIG. 4 is a top plan view showing the exhaust device and associated exhaust pipes.

It should be noted from FIG. 4 that the exhaust pipes 66, 67, 68 and 69 are all disposed between the H arms of the front suspension arm 21 but are disposed so as to be closer to one of the pivot points 22 than the other. The exhaust pipe 69 is quite close to this pivot and accesses and servicing the pivot can be a problem if the exhaust pipe 69 is formed in unit with the exhaust device 71 as are the exhaust pipes 66, 67 and 68, as will be described. Therefore, the exhaust pipe 69 is connected to the exhaust device 71 in such a way that it can be removed so as to service the front suspension without requiring removal of the complete exhaust system 65.

The exhaust device 71 is formed of an outer housing that is made up of sheet metal components consisting of a lower shell 72, an upper shell 73 and a front shell 74. The shells 72, 73 and 74 are affixed to each other, as by welding, and define an internal cavity. The discharge ends of the exhaust pipes 66, 67 and 68 extend through appropriate openings in the front shell 74 and are affixed thereto as by welding. A slip type bushing 75 also extends through the front shell 74 and is affixed thereto by welding. The exhaust pipe 69 has a slip fit within the bushing 75 and is held in sealing engagement therewith by means of a split type clamp 76 and fastener 77. As a result, the exhaust pipe 69 may be readily removed, as aforenoted, without necessitating removal of the complete exhaust system.

The internal volume of the exhaust device 71 acts like an expansion chamber and there is further provided a catalyst bed 78 within this cavity through which the exhaust gases must pass. A supporting bracket 79 is affixed to the shells 72 and 73 in a suitable manner and prevents any gas leakage from around the periphery of the catalyst bed 78.

The exhaust gases that have passed through the catalyst bed 78 then may enter a protuberance 81 formed at the rear end of the exhaust device 71 and with which a tail pipe 82 communicates for discharging the exhaust gases to the atmosphere.

It should be noted that the crankcase 51 has a downwardly extending portion 83 that extends forwardly of the exhaust device 71 and also the main portion of crankcase 51 overlies the exhaust device 71. A pair of supporting brackets 84 are affixed to the top shell 73 as by welding and are mounted on mounting brackets 85 that are affixed to a lower portion 86 of the crankcase 51 by means of threaded fasteners 87. Elastic joints 88 complete the suspension of the exhaust device 71 from the crankcase 51.

It will be noted that, in front elevational view, the peripheral edges of the exhaust device 71 and the point of contact of the front and rear wheels with the ground define a pair of intersecting planes indicated by the lines 89 and 90 respectively. These planes define the maximum lean angles $\theta_1$ and $\theta_2$ at which the motorcycle 11 may be leaned when it is ridden.

In conjunction with the engine control system, there is provided an oxygen sensor, indicated generally by the reference numeral 91 which has a sensor portion (not shown) that extends into the exhaust device 71 for sensing the oxygen content in the exhaust gases. A terminal 92 is disposed externally of the exhaust device 71 and provides means for attachment of a conductor (not shown) that extends to the control mounted in the aforenoted recess 62 for engine control. It is important that the sensors 91 be protected from foreign objects as may be thrown up by the wheels 19 and 28 during their riding and also so that it will not contact the ground during this leaning action. Therefore, in accordance with the invention, the sensor 91 is mounted in the upper shell 73 free of the surface area of the exhaust device 71 that lies between the contact points with the planes 89 and 90 so as to be protected by the exhaust device 71 itself from these foreign objects. In addition, the sensor 91 is positioned rearwardly of the exhaust pipes 66, 67, 68 and 69 and behind one of the mounting brackets 84 so as to be further protected from injury by any foreign objects.

Figure 5:
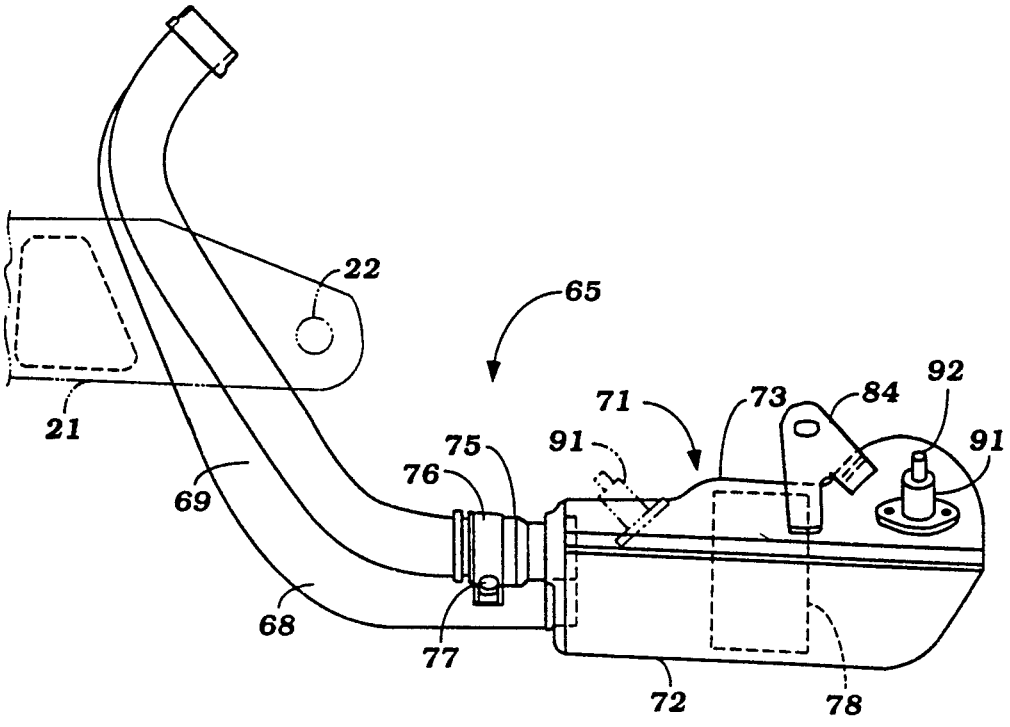
FIG. 5 is a side elevational view of the construction shown in FIG. 4 with certain components of the motorcycle being shown in phantom for orientation purposes.

Alternatively to the rear and side mounting as shown in the figures, the sensor 91 may be mounted at a forward position as long as it is in the top shell 73 and outside of the planes 89 and 90 and also behind the exhaust pipes 66, 67, 68 and 69 for protection. Such an alternative location is shown in phantom in FIGS. 4 and 5.

It should be readily apparent from the foregoing description that the described embodiments of the invention provide a very effective way of protecting an oxygen sensor as mounted in the exhaust system of a motorcycle. Although the invention is described in conjunction with an oxygen sensor, it should be readily apparent that the invention may be employed in conjunction with any other type of sensor employed in the exhaust system of a motorcycle. In addition, various other changes and modifications may be made without departing from the spirit and scope of the invention, as defined by the appended claims.

We claim:

1. A motorcycle having a body assembly supported upon a dirigible front wheel and a rear wheel, an internal combustion engine supported by said body assembly for driving at least one of said wheels, an exhaust system for discharging exhaust gases from said engine to the atmosphere, said exhaust system including an exhaust device for treating exhaust gases positioned at a lower portion of said body assembly and between said front and said rear wheels, said exhaust device having peripheral side edges in front elevation that lie within a pair of intersecting planes meeting at a line defined generally by the contact of said front and rear wheels with a ground plane upon which said motorcycle is disposed, a supporting bracket affixed to said exhaust device for mounting said exhaust device on said body assembly, and a sensor mounted at least in part within said exhaust device and having a portion thereof extending outwardly beyond the outer periphery of said exhaust device, said sensor portion lying outside of the surface area of said exhaust device extending between said planes and to the rear of said supporting bracket for protecting said sensor portion from foreign objects by said exhaust device.

2. A motorcycle as set forth in claim 1 wherein the sensor portion extends into the upper surface of the exhaust device.

3. A motorcycle as set forth in claim 2 wherein a further portion of the motorcycle is positioned to protect the sensor.

4. A motorcycle as set forth in claim 3 wherein the further portion of the motorcycle protecting the sensor comprises another portion of the exhaust system.

5. A motorcycle as set forth in claim 4 wherein the other portion of the exhaust system comprises a further part of the exhaust device.

6. A motorcycle as set forth in claim 4 wherein the further part of the exhaust system that protects the sensor comprises an exhaust pipe for delivering exhaust gases from the engine to the exhaust device.

7. A motorcycle as set forth in claim 6 wherein there are a plurality of exhaust pipes that deliver exhaust gases from the engine to the exhaust device and which protect the sensor.

8. A motorcycle as set forth in claim 7 wherein one of the plurality of exhaust pipes is disposed adjacent a component of the motorcycle to be serviced and is readily detachable from the remaining components of the exhaust system for servicing said motorcycle element.

9. A motorcycle as set forth in claim 1 wherein the exhaust device is comprised of upper and lower shells welded to each other.

10. A motorcycle as set forth in claim 9 wherein a further portion of the motorcycle is positioned to protect the sensor.

11. A motorcycle as set forth in claim 10 wherein the further portion of the motorcycle protecting the sensor comprises another portion of the exhaust system.

12. A motorcycle as set forth in claim 11 wherein the other portion of the exhaust system comprises a further part of the exhaust device.

13. A motorcycle as set forth in claim 11 wherein the further part of the exhaust system that protects the sensor comprises an exhaust pipe for delivering exhaust gases from the engine to the exhaust device.

14. A motorcycle as set forth in claim 13 wherein there are a plurality of exhaust pipes that deliver exhaust gases from the engine to the exhaust device and which protect the sensor.

15. A motorcycle as set forth in claim 14 wherein one of the plurality of exhaust pipes is disposed adjacent a component of the motorcycle to be serviced and is readily detachable from the remaining components of the exhaust system for servicing said motorcycle element.

16. A motorcycle having a body assembly supported upon a dirigible front wheel and a rear wheel, an internal combustion engine supported by said body assembly for driving said wheels, an exhaust system for discharging exhaust gases from said engine to the atmosphere, said exhaust system including a plurality of exhaust pipes affixed at one end to the engine for receiving exhaust gases therefrom and extending downwardly and rearwardly beneath the engine, an exhaust device for receiving exhaust gases from said exhaust pipes for treatment and discharge to the atmosphere, said motorcycle having at least one component requiring servicing, one of said exhaust pipes being juxtaposed to said component, and means for detachably connecting said one exhaust pipe from said engine and said exhaust device for servicing said component, the remainder of said exhaust pipes being welded to said exhaust device to form a unitary assembly.

17. A motorcycle as set forth in claim 16 wherein the component requiring servicing comprises a pivot joint for a front wheel suspension element.

18. A motorcycle as set forth in claim 17 wherein the front wheel suspension element is a leading arm.

19. A motorcycle as set forth in claim 16 wherein the exhaust pipes are disposed in side by side relationship and the detachable exhaust pipe is an outer one of the exhaust pipes.

20. A motorcycle as set forth in claim 1 wherein there are a pair of supporting brackets affixed to the exhaust device each positioned forwardly of the sensor and wherein the sensor is positioned closer to one of the supporting brackets.

* * * * *